US006333606B1

(12) United States Patent
Lee et al.

(10) Patent No.: US 6,333,606 B1
(45) Date of Patent: Dec. 25, 2001

(54) BALLAST FOR DISCHARGE LAMP

(75) Inventors: Chung-Woo Lee; Jong-Il Eun, both of Seoul (KR)

(73) Assignee: Lestec. Co., Ltd. (KR)

( * ) Notice: Subject to any disclaimer, the term of this patent is extended or adjusted under 35 U.S.C. 154(b) by 0 days.

(21) Appl. No.: 09/610,974

(22) Filed: Jul. 6, 2000

(30) Foreign Application Priority Data

Jul. 26, 1999 (KR) ..... 99-30360

(51) Int. Cl.[7] ..... G05F 1/00

(52) U.S. Cl. ..... 315/291; 315/307; 315/224; 315/209 R

(58) Field of Search ..... 315/291, 307, 315/308, 224, 209 R, 247, DIG. 4, DIG. 5, DIG. 7, DIG. 2, 212, 213, 214

(56) References Cited

U.S. PATENT DOCUMENTS 5,394,062 * 2/1995 Minarczyk et al. ..... 315/129
5,406,177 * 4/1995 Nerone ..... 315/307
5,426,348 * 6/1995 Qi ..... 315/209 R
5,539,281 * 7/1996 Shackle et al. ..... 315/224

* cited by examiner

*Primary Examiner*—Don Wong
*Assistant Examiner*—Ephrem Alemu
(74) *Attorney, Agent, or Firm*—Bacon & Thomas PLLC

(57) ABSTRACT

A ballast for discharge lamp. The ballast for discharge lamp for utilizing high frequency voltage is generated by alternatively switching two switching elements to light the discharge lamp. The ballast includes a primary winding of a switching transformer to which the high frequency voltage is applied; a secondary winding of a switching transformer for alternatively switching the two switching elements according to reverse electromotive voltage generated by application of high frequency voltage to the primary winding; and a stabilizer for stabilizing reverse electromotive voltage generating at the secondary winding.

3 Claims, 2 Drawing Sheets

BALLAST FOR DISCHARGE LAMP

BACKGROUND OF THE INVENTION

1. Field of the Invention

The present invention relates to a ballast for a discharge lamp, and more particularly to a ballast for a discharge lamp adapted to prevent a flicker effect and acoustic resonant phenomenon generated in the lighting of high voltage discharge lamp, such as a metal lamp, sodium lamp and the like.

2. Description of the Prior Art

When a discharge lamp is lighted and after the lamp is lighted in a conventional ballast for discharge lamp, there is a problem in that the voltage and a current difference are generated due to discharge and resonant frequency variation, resulting in acoustic resonant phenomenon and flicker effect.

Particularly, there is another problem in that a voltage or a current characteristic differs a little bit even in discharge lamps of identical design that one manufactured by the same company, and such difference frequently changes resonant frequency of the discharge lamps, and there is great difficulty in solving the acoustic resonant phenomenon and flicker effect.

SUMMARY OF THE INVENTION

The present invention solves the aforementioned problems of the prior art and it is an object of the present invention to provide a ballast for a discharge lamp adapted to prevent resonant frequency of the discharge lamp from fluctuating due to voltage and current difference of the discharge lamp when the discharge lamp is lighted and after the discharge lamp is lighted, thereby avoiding the acoustic resonant phenomenon and flicker effect, and prolonging the life of the discharge lamp as well.

There is another object of the present invention to provide a ballast for a discharge lamp adapted to constantly maintain the resonant frequency of the discharge lamp even though intrinsic voltage and current characteristics of the discharge lamp are different, thereby preventing acoustic resonant phenomenon and flicker effect and prolonging life of the discharge lamp as well.

In accordance with the objects of the present invention, there is provided a ballast for discharge lamp, the ballast for discharge lamp fur utilizing high frequency voltage generated by alternatively switching two switching elements to light the discharge lamp, the ballast comprising:

a primary winding of a switching transformer to which the high frequency voltage is applied;

a secondary winding of a switching transformer for alternatively switching the two switching elements according to reverse electromotive voltage generated by application of high frequency voltage to the primary winding; and stabilizing means for stabilizing reverse electromotive voltage generating at the secondary winding, wherein the stabilizing means comprises:

a control winding where reverse electromotive voltage is generated according to high frequency voltage applied to the primary winding;

a diode for half-rectifying the reverse electromotive voltage generated at the winding for control;

charging/discharging circuit for receiving the reverse electromotive voltage half-rectified by the diode to charge and discharge according to charging/discharging time constant; and a transistor for switching according to a voltage value of the charge/discharge circuit to control reverse electromotive voltage generated at the secondary winding.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
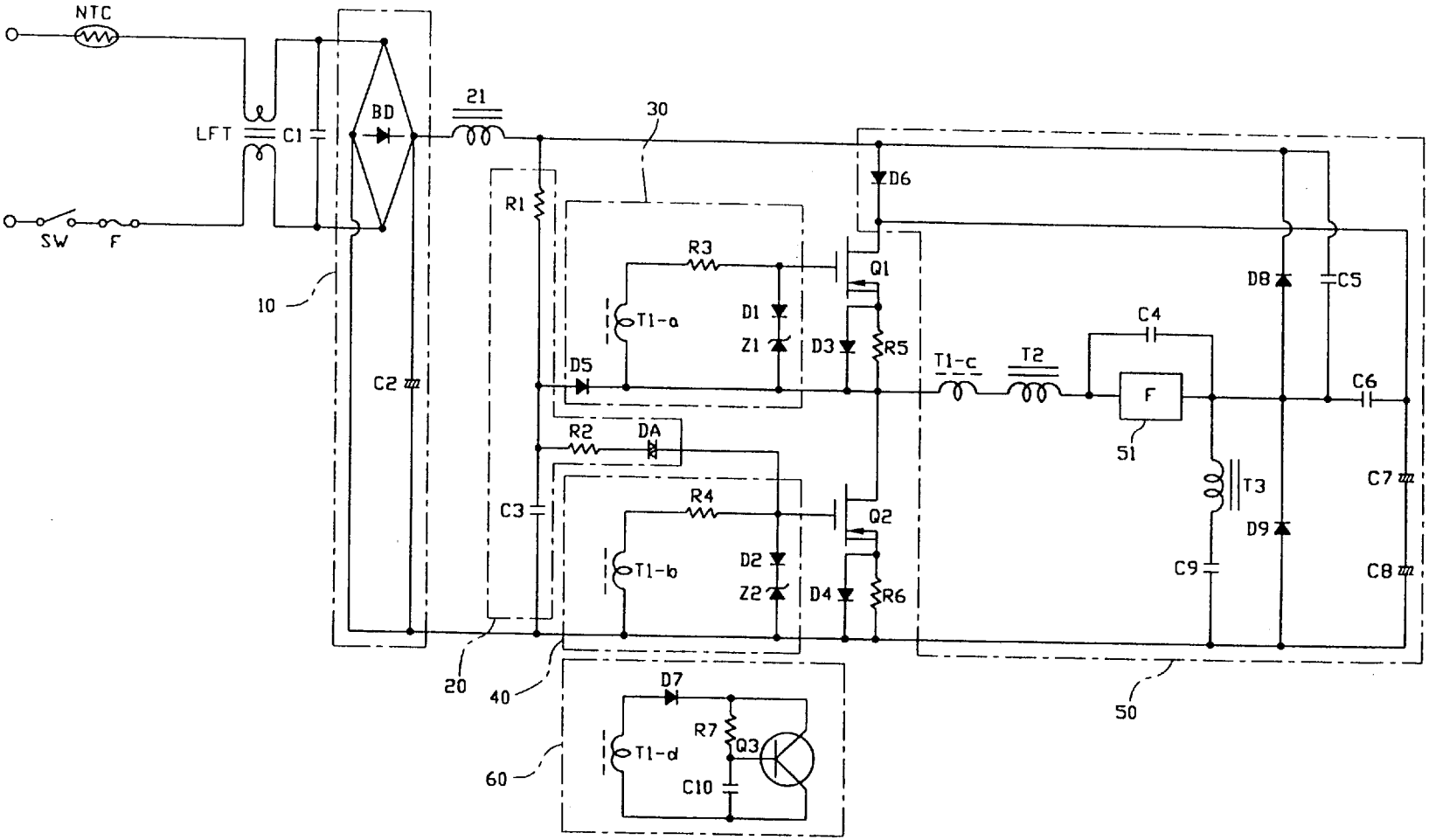
FIG. 1 is a circuit diagram of a ballast for discharge lamp according to the present invention.

FIG. 1 is a circuit diagram of a ballast for discharge lamp according to the present invention, where the ballast for the discharge lamp includes AC/DC converter 10, a starter 20, a first switching controller 30, a second switching controller 40, discharge lamp driver 50 and a stabilizer 60.

The AC/DC converter 10 for serving to convert an alternating current AC source input from outside to a direct current DC source includes a bridge diode (BD) and a smoothing condenser (C2). The starter 20 outputs a starting signal when a DC voltage is applied from the AC/DC converter 10, and includes resistors (R1 and R2), a condenser (C3) and a diode AC switch (DIAC).

The first switching controller 30 and the second switching controller 40 alternatively switch a first switching element (Q1) and a second switching element (Q2) when a starting signal is output from the starter 20 to supply high frequency voltage to the discharge lamp driver 50, and includes secondary windings of switching transformer (T1-*a* and T1-*b*), resistors (R3 and R4) diodes (D1 and D2) and zenor diodes (Z1 and Z2).

The discharge lamp driver 50 serves to receive the high frequency voltage supplied by the switching operation of the first switching element (Q1) and the second switching element (Q2) to light the discharge lamp 51 and includes a first winding (T1-*c*) of switching transformer, inductors (T2 and T3), condensers (C4~C9) and diodes (D6, D8 and D9).

The stabilizer 60 serves to stabilize the reverse electromotive voltage induced to the secondary windings (T1-*a*, T1-*b*) of the first switching controller 30 and the second switching controller 40 according to high frequency voltage supplied to the discharge lamp driver 50 by switching operation of the first switching element Q1 and the second switching element Q2 and includes a control winding (T1-*d*) of switching transformer, a diode (D7), a resistor (R7), a condenser (C10) and a transistor (Q3).

Figure 2:
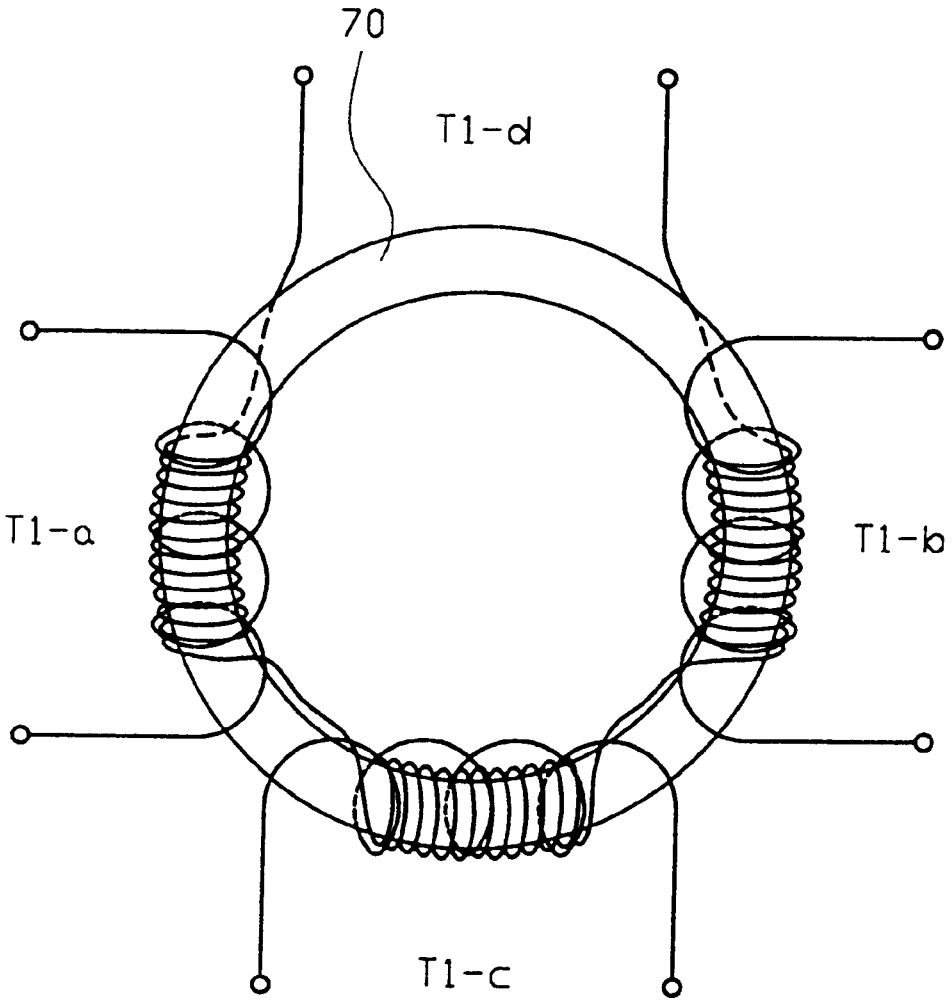
FIG. 2 is a schematic structural drawing of a switching transformer according to the present invention.

Furthermore, the switching transformer according to the present invention is constructed such that the control winding (T1-*d*) thereof is overlapped on the first winding (T1-*c*) and the second windings (T1-*a*, T1-*b*) to be wound on a magnetic core 70 at inner sides of the first winding (T1-*c*) and the second windings (T1-*a*, T*a*–*b*), as illustrated in FIG. 2.

Now, operational effect of the ballast for discharge lamp thus constructed according to the present invention will be described in detail with reference to the accompanying drawings.

When a user turns on a discharge lamp switch (SW), an alternating current (AC) source supplied from outside is input to a bridge diode (BD) of the AC/DC converter 10 through a rush preventing resistor (NTC), a fuse (F), a noise removing transformer (LFT) and a condenser (C1).

The bridge diode (BD) full-wave rectifies the AC to output same to the smoothing condenser (C2), where the smoothing condenser (C2) smooths the full-wave rectified DC source to supply same via a power factor improving inductor 21.

At this time, DC voltage input through the power factor improving inductor 21 and the resistor R1 is charged in the condenser C3 of the start 20, where the DIAC (DA) is conducted the moment the charged voltage surpasses the driving voltage of the DIAC (DA) and a starting signal, that is, a high-leveled voltage signal, is applied to a gate terminal of the second switching element (Q2) to turn on the second switching element (Q2).

When the second switching element (Q2) is thus turned on, current supplied from the power factor improving inductor 21 flows through condensers (C5, C6, C4) of the discharge lamp driver 50, inductor (T2), primary winding (T1-*c*) of the switching transformer and the second switching element (Q2).

Furthermore, when charge of the condensers (C5, C6) is completed, current flow of the primary winding at the switching transformer is blocked to cause reverse electromotive voltage to form at the secondary winding (T1-*a*) of the switching transformer and the first switching element (Q1) is turned on by the reverse electromotive voltage.

When the first switching element (Q1)is turned as described in the above, current supplied through the power factor improving inductor 21 flows through diode (D6), first switching element (Q1), primary winding (T1-*c*) of the switching transformer, inductor (T2) and condensers (C4, C5 and C6).

When the condenser (C6) is completed in charge thereof, current flow at the primary winding (T1-*c*) of the switching transformer is stopped, preventing the reverse electromotive voltage from being generated at the secondary winding (T1-*b*) of the switching transformer, resulting in the second switching element (Q2) to be turned on according to the reverse electromotive voltage.

In other words, reverse electromotive voltage is alternatively generated at the secondary windings (T1-*a*, T1-*b*) of the switching transformer by discharge of the condenser (C6) to cause the first and second switching elements (Q1 and Q2) to repeatedly perform the switching operation such that the high frequency voltage is supplied to the discharge lamp driver 50.

At this time, over current and over voltage are prevented from being applied to gate terminals of the first and second switching elements (Q1 and Q2) by the resistors (R3 and R4) and zenor diodes (Z1 and Z2) connected to gate terminals of the first and second switching elements (Q1 and Q2), such that the first and second switching elements (Q1 and Q2) are avoided from being damaged.

Furthermore, source terminals of the first and second switching elements (Q1 and Q2) are connected with diodes (D3 and D4) and current attenuating resistors (R5 and R6), such that, when the first and second switching elements (Q1 and Q2) are turned on, current is supplied through the diodes (D3 and D4), and after the first and second switching elements (Q1 and Q2) are turned on, the current supplied from the discharge lamp driver 50 through the current attenuating resistors (R5 and R6) is restricted to thereby prevent the flicker effect.

Meanwhile, when frequency of the high frequency voltage applied to the discharge lamp driver 50 by the switching operation of the first and second switching elements (Q1 and Q2) becomes equal to resonant frequency of a resonant circuit having inductor (T2) and condenser (C4) of the discharge lamp driver 50, a high voltage is generated at both ends of the condenser (C4) to light the discharge lamp 51.

After the discharge lamp 51 is lighted, the resonant frequency starts to be changed due to different voltage and current characteristics of the discharge lamp 51, where the stabilizer 60 maintains the resonant frequency at a constant level to prevent the acoustic resonant phenomenon and the flicker effect from happening.

In other words, reverse electromotive voltage is inducted on the control winding (T1-*d*) of the stabilizer 60 according to the resonant frequency and the electromotive voltage is half-wave rectified by the diode (D7) to be charged at the condenser (C1O) through resistor (R7), such that at every half cycle of the resonant frequency, the condenser (C1O) is charged.

When the condenser (C10) is charged, the transistor (Q3) is turned on to reduce the reverse electromotive voltage inducted on the secondary windings (T1-*a*, T*a*–*b*) of the switching transformer, thereby charging flow of current flowing through the first and second switching elements (Q1 and Q2).

Accordingly, when charge/discharge time constant of the charge/discharge circuit having the resistor (R7) and the condenser (C10) is adjusted to fixedly place the resonant frequency at a bandwidth where no acoustic resonance occurs, the acoustic resonant phenomenon and the flicker effect are not generated even though voltage and current characteristics of the discharge lamp 51 or input voltage are changed.

As apparent from the foregoing, there is an advantage in the ballast for discharge lamp thus described according to the present invention in that resonant frequency of a discharge lamp is prevented from fluctuating due to difference in voltage and current characteristics when the discharge lamp is lighted and after the discharge lamp is lighted, thereby avoiding acoustic resonant phenomenon and flicker effect and prolonging life of the discharge lamp as well.

There is another advantage in that resonant frequency of the discharge lamp is constantly maintained regardless of intrinsic voltage and current characteristics of the discharge lamp, thereby preventing acoustic resonant phenomenon and flicker effect and prolonging life of the discharge lamp as well.

What is claimed is:

1. A ballast for discharge lamp, the ballast for discharge lamp for utilizing high frequency voltage generated by alternatively switching two switching elements to light the discharge lamp, the ballast comprising:

a primary winding of a switching transformer to which the high frequency voltage is applied;

a secondary winding of a switching transformer for alternatively switching the two switching elements according to reverse electromotive voltage generated by application of high frequency voltage to the primary winding; and stabilizing means for stabilizing reverse electromotive voltage generating at the secondary winding, the stabilizing means comprises:

a control winding where reverse electromotive voltage is generated according to high frequency voltage applied to the primary winding;

a diode for half-rectifying the reverse electromotive voltage generated at the winding for control;

charging/discharging circuit for receiving the reverse electromotive voltage half-rectified by the diode to charge and discharge according to charging/discharging time constant; and a transistor for switching according to a voltage value of the charge/discharge circuit to control reverse electromotive voltage generated at the secondary winding.

2. The ballast for discharge lamp as claimed in claim 1, wherein the control winding is wound on a magnetic core inside of the primary winding and the secondary winding.

3. The ballast for discharge lamp according to claims 1 or 2, wherein the first switching element and the second switching element are connected at source terminal thereof with a diode and a current attenuating resistor.

* * * * *